United States Patent [19]

Deininger et al.

[11] Patent Number: 4,533,070

[45] Date of Patent: Aug. 6, 1985

[54] VARIABLE VOLUME METERING VALVE FOR DISPENSING BEVERAGE CONCENTRATES

[75] Inventors: Anton Deininger, Bachhagel; Hartmann Nelzow; Karlheinz Färber, both of Giengen, all of Fed. Rep. of Germany

[73] Assignee: Bosch-Siemens Hausgeraete GmbH, Stuttgart, Fed. Rep. of Germany

[21] Appl. No.: 599,266

[22] Filed: Apr. 11, 1984

Related U.S. Application Data

[62] Division of Ser. No. 299,640, Sep. 4, 1981.

[30] Foreign Application Priority Data

Sep. 9, 1980 [DE] Fed. Rep. of Germany ..... 3033873

[51] Int. Cl.[3] ..... B67D 3/00

[52] U.S. Cl. ..... 222/439; 222/288; 222/453

[58] Field of Search ..... 222/288, 434, 438, 439, 222/451, 453, 504, 282, 442, 562, 563

[56] References Cited

U.S. PATENT DOCUMENTS 1,584,878 5/1926 McQuarrie ..... 222/288 X 1,834,628 12/1931 Marshall et al. ..... 222/288

2,322,866 6/1943 Merz ..... 222/288

4,109,829 8/1978 Kuckens et al. ..... 222/453 X

*Primary Examiner*—Joseph J. Rolla

*Assistant Examiner*—Kevin P. Shaver

*Attorney, Agent, or Firm*—Herbert L. Lerner; Laurence A. Greenberg

[57] ABSTRACT

Metering valve, including a substantially vertically-disposed tubular housing, the housing having an upper and a lower end, the lower end of the housing having a valve seat formed thereon and an outlet opening formed therein, a cap being integral with the upper end of the housing and having an impact surface formed thereon, a substantially tubular ram being axially liftable by a magnetic force field in the housing, the ram having an upper and a lower end, the lower end of the ram having a sealing cone formed thereon and the ram having drainage ports formed therein in vicinity of the sealing cone, the drainage ports being operable to leak fluid below the ram when the ram is lifted, the upper end of the ram being operable to adjoin the impact surface of the cap when the ram is lifted, and the valve seat having at least one selectively operable air inlet formed therein being associated with the outlet opening.

1 Claim, 3 Drawing Figures

FIG. 1a
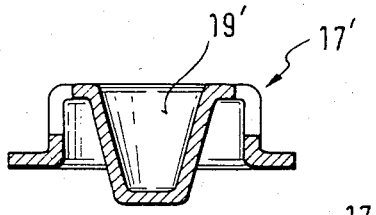
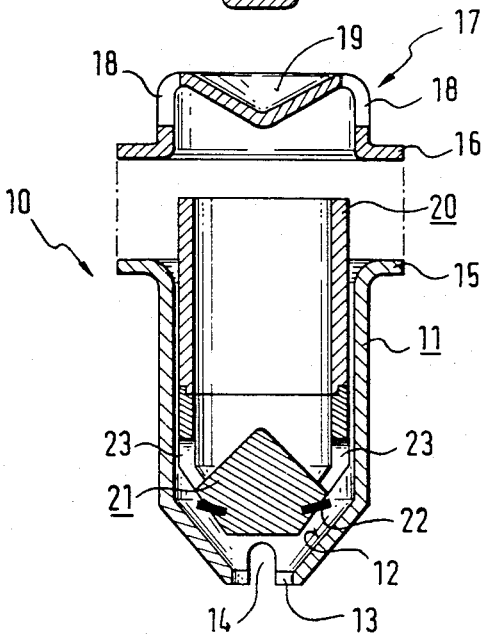
FIG. 1
FIG. 2
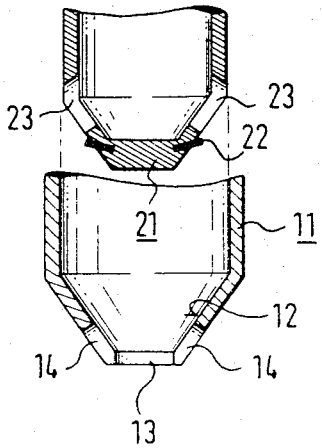

VARIABLE VOLUME METERING VALVE FOR DISPENSING BEVERAGE CONCENTRATES

This is a division of application Ser. No. 299,640, filed Sept. 4, 1981.

The invention relates to a metering valve, especially for discharging beverage concentrates in automatic beverage machines, having an at least approximately vertically-disposed tubular housing having its lower end equipped with a valve seat and an output opening, and its top capped. In the housing an equally tubular-shaped ram which has a bottom seal cone and is axially guided by a lifting effect of a magnetic force field, is provided in the area of its seal cone with drainage ports.

The disadvantage of known metering valves of this type is that during opening from below air flows in through the outlet opening, which upon encountering a run-out of beverage concentrate is encapsulated by it in the form of relatively large air bubbles. The air bubbles have a tendency to rise in the outflowing beverage concentrate and therefore produce a pumping effect, which obstructs an unrestricted and uniform flow-off of the beverage concentrate. This undesirable pumping effect is extremely strong primarily in cases where the beverage concentrate is of a high viscosity type such as because of high sugar content or low temperature. In extreme cases this undesirable effect can even result in a blocking of the metering valve, if large-size air bubbles settle in narrow metering valve flow cross-sections, and thus prevent the runout of beverage concentrate.

There has accordingly been no dearth of proposals made for suppressing this undesirable pumping effect so frequently encountered with metering devices of this type. However, these call for equipping the metering valve with complex ventilating or evacuating devices. The additional expense required for this purpose, however, quite considerably boosts the manufacturing costs for metering valves such as these. Aside from this, metering valves equipped with prior art ventilating or evacuating devices in many cases are particularly susceptible to breakdowns. It is accordingly an object of the invention to provide a metering valve, especially for discharge beverage concentrates in automatic beverage machines, which overcomes the hereinafore-mentioned disadvantages of the heretofore-known devices of this general type, and to do so in such a simple way that the rising air bubble pumping effect is avoided to a large extent.

With the foregoing and other objects in view there is provided, in accordance with the invention, a metering valve, especially for discharging beverage concentrates in automatic beverage machines, comprising a substantially vertically-disposed tubular housing, the housing having an upper and a lower end, the lower end of the housing having a valve seat formed thereon and an outlet opening formed therein, a cap being contiguous with the upper end of the housing and having an impact surface formed thereon, a substantially tubular ram being axially liftable by a magnetic force field in the housing, the ram having an upper end and a lower end, the lower end of the ram having a sealing cone formed thereon and the ram having drainage ports formed therein in vicinity of the sealing cone, the drainage ports being operable to leak fluid or concentrate below the ram when the ram is lifted, the upper end of the ram being operable to adjoin the impact surface of the cap when the ram is lifted, and the valve seat having at least one selectively operable air inlet formed therein being associated with the outlet opening.

Because of the opening in the conical valve seat selectively used as an air inlet according to the invention, a constant, quiet runout of a measured amount of beverage concentrate is assured.

In accordance with another feature of the invention, the air inlet is in the form of a lateral servo-opening cutout portion of the outlet opening.

In accordance with a further feature of the invention, the air inlet is associated with at least one of the drainage ports formed in the sealing cone of the ram. This way any air bubbles encapsulated in the beverage concentrate can freely rise without restricting a uniform runout of the concentrate.

In accordance with an added feature of the invention, the upper end of the ram has an opening formed therein, and the cap has a cavity formed therein forming a portion of the cap for determining a volume of the ram, the portion being at least partially extended from above into the opening in the upper end of the ram when the ram is lifted to the impact surface.

In accordance with a concomitant feature of the invention, the cap is easily detachably and interchangeably mounted on the housing.

Other features which are considered as characteristic for the invention are set forth in the appended claims.

Although the invention is illustrated and described herein as embodied in a metering valve, especially for discharging beverage concentrates in automatic beverage machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic cross-sectional view of an embodiment of the metering valve of the invention, having a tubular housing with an axially-shiftable ram operating inside, and a housing cap used as a ram stop;

FIG. 1*a* is a cross-sectional view of a second embodiment of a cap set on the tubular housing of the metering valve; and FIG. 2 is another cross-sectional view through the lower section of the metering valve, representing a 90° turn with respect to FIG. 1 and having a differently shaped sealing cone.

Referring now to the figures of the drawings, and first particularly to FIG. 1 thereof, it is seen that a metering valve designated with reference numeral 10, for the measured output of prepared automatic beverage machine concentrates, has a vertically-disposed tubular housing 11, which is provided at the bottom thereof with a conical section used as a valve seat 12. The valve seat has a central outlet opening 13 in the shape of a circular perforation. The outlet opening 13 is equipped on its opposite sides with cutouts 14, which are selectively used as air inlets as described further below.

The housing 11 is equipped on the top thereof with a flange 15. A cap 17 having an identical flange 16 equipped thereon can be set on the flange 15. The upwardly cambered cap 17 is equipped with a plurality of sidewall perforations 18, and a centrally-disposed plate 19 serving as an impact stop surface. The center of the plate 19 again has an inverse shaped cavity.

In the interior of the tubular housing 11, is disposed a similarly tubular-type ram 20 which is supported in an axially shiftable way and has a seal cone 21 at its lower end. The seal cone 21 is provided with a flat packing ring 22. Above the ring 22 there are drainage ports 23 located in the seal cone, from which the beverage concentrate in the interior of the ram 20 can leak out as soon as the ram 20 lifts under the effect of the magnetic field of a non-illustrated electromagnet. Specifically shown in FIG. 2 are two drainage ports 23, which are associated with cutouts 14 that are adjacent to an outlet opening 13. The sealing cone 21 has a different shape than that shown in FIG. 1, to provide a different capacity for the ram.

Because of a gravitational effect, the ram normally is set on the conical valve seat 12 of the housing 11 with its packing 22 disposed on its seal cone 21. This effectively seals the outlet opening 13 and laterally adjoining cutouts 14. In the idle position of the ram 20, the beverage concentrate can after or post-flow from a container disposed on the metering valve 10 into the interior of the ram 20 through the perforations 18 in the cap 17. As soon as the electromagnet is excited, the ram 20 lifts because of the force of the effect produced by the magnetic field, and the ram shifts axially upward until it abuts with its top edge on the plate 19. In this position, the concentrate stored in the ram can leak out below through the now open drainage ports 23 and be discharged through the outlet opening 13. Simultaneously air flows through the lateral cutout 14 and the associated drainage ports 23 into the interior of the ram 20. The sealing off of the ram interior produced by the joint fit of the ram 20 and the plate 19 blocks any further after-flow of beverage concentrate into the ram interior through the perforations 18. As soon as the measured amount of beverage concentrate as determined by the given ram volume has drained off below through the drainage ports and the ram has again dropped to its gravitational base following the collapse of the magnetic field, any further beverage concentrate can flow into the interior of ram 20 through the now released perforations 18. The sequence repeats itself until the air having previously penetrated through the cutouts 14 and their associated drainage ports 23, has been displaced from the interior of the ram 20.

The cap 17′ shown in FIG. 1*a* differs from the cap 17 according to FIG. 1 only to the extent that in FIG. 1*a* the cavity at the center of the plate 19′ is substantially more emphasized. Thus the volumes dispensed by the metering valve 10 can be varied in a simple way be interchanging caps. This makes it feasible to use one type of metering valve for measuring concentrates having varying strengths as long as in each applicable case caps having a differently shaped cavity are mounted on the metering valve. Accordingly, with weak concentrates metering valves having almost non-existent cavities are used, while with strong concentrates the caps are provided with a particularly strongly emphasized cavity. The key to the illustrated and described embodiment is the interaction of the lateral cutouts 14 on the outlet opening 13 with their associated drainage ports 23. The result is that with the ram lifted the air is timed to flow in below when the jet of beverage concentrate running out is off and the air flow cannot interfere with the concentrate jet. In this way a rapid, constant, and quiet outflow of beverage concentrate from the metering valve is accomplished. To support the effect produced with the hereinafore-described arrangement, individual drainage ports 23 can be given various diameters and also various operating levels. Aside from this there is also a potential for screening off drainage ports designated as air inlets from those from which concentrate leaks, by deflectors or similar means.

There is claimed:

1. Metering valve, comprising a substantially vertically-disposed, tubular housing, said housing having an upper and a lower end, said lower end of said housing having a valve seat formed thereon and an outlet opening formed in said valve seat, a substantially tubular ram being axially liftable in said housing, said ram having an upper end and a lower end, said lower end of said ram having a sealing cone formed thereon engaging said valve seat when said ram is lowered, and said ram having drainage ports formed therein in vicinity of said sealing zone, said draining ports being operable to leak fluid below said ram when said ram is lifted, and interchangeable cap means attachable to the upper end of said tubular housing and having a convex impact surface thereon, said impact surface extending into the upper end of said tubular ram when said ram is lifted, said convex impact surface having predetermined dimensions for metering the volume of fluid that can be contained within said tubular ram, and said cap having an opening formed therein for admitting fluid into said ram.

* * * * *